US006558120B2

(12) United States Patent
Kim et al.

(10) Patent No.: US 6,558,120 B2
(45) Date of Patent: May 6, 2003

(54) TURBO FAN OF A CEILING-EMBEDDED CASSETTE TYPE AIR CONDITIONER HAVING AN IMPROVED STRUCTURE

(75) Inventors: Sung Chun Kim, Seoul (KR); Young Min Park, Incheon (KR); Jong Han Park, Gyeonggi-Do (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/879,947

(22) Filed: Jun. 14, 2001

(65) Prior Publication Data

US 2002/0110455 A1 Aug. 15, 2002

(30) Foreign Application Priority Data

Feb. 12, 2001 (KR) ..... 01-6794

(51) Int. Cl.[7] ..... F04D 29/28
(52) U.S. Cl. ..... 416/186 R; 416/189; 416/241 A
(58) Field of Search ..... 416/185, 188, 416/189, 241 A, 223 B, 186 R

(56) References Cited

U.S. PATENT DOCUMENTS 4,647,271 A * 3/1987 Nagai et al. ..... 416/186 R
5,927,947 A * 7/1999 Botros ..... 416/144
6,042,335 A * 3/2000 Amr ..... 415/208.1
6,283,726 B1 * 9/2001 Fackelmann et al. ..... 417/366
6,299,409 B1 * 10/2001 Matsunaga et al. ..... 415/206

* cited by examiner

*Primary Examiner*—Ninh Nguyen
(74) *Attorney, Agent, or Firm*—Birch, Stewart, Kolasch & Birch, LLP

(57) ABSTRACT

A turbo fan of a ceiling-embedded cassette type air conditioner. The turbo fan has a shroud for guiding a fluid introduced into the turbo fan, a hub having an outer diameter smaller than an inner diameter of the shroud, so as to facilitate an integral injection molding of the turbo fan, and blades extending between the shroud and the hub and being perpendicular to the shroud and the hub. Each of the blades has an inner diameter decreasingly inclined from the shroud to the hub, so that a quantity of sucked-air and a static pressure can be increased. The turbo fan not only can be integrally formed by injection molding but also can be manufactured at a reduced manufacturing cost.

20 Claims, 5 Drawing Sheets

TURBO FAN OF A CEILING-EMBEDDED CASSETTE TYPE AIR CONDITIONER HAVING AN IMPROVED STRUCTURE

BACKGROUND OF THE INVENTION

1. Field of the Invention

The present invention relates to a ceiling type air conditioner, which is installed to an indoor ceiling of a building, so as to purify the indoor air and properly adjust the temperature and humidity of the indoor air to be maintained at a desired level, thereby providing more pleasant life environment. More particularly, the present invention relates to an improved structure of a turbo fan, an element employed in a ceiling type air conditioner so as to generate fluid flow, which improvement enables the turbo fan to be employed in the air conditioner more conveniently and more efficiently.

2. Description of the Related Art

Hereinafter, firstly given will be a description of an entire construction of a conventional ceiling-embeded cassette type air conditioner, which will be followed by a description of a conventional turbo fan structure employed in the conventional ceiling-embeded cassette type air conditioner.

FIG. 1 is a bottom view of a conventional ceiling-embeded cassette type air conditioner.

Referring to FIG. 1, the conventional ceiling-embeded cassette type air conditioner has a suction port 11, through which indoor air is introduced, and exhaust ports 12 formed around the suction port 11. In the conventional air conditioner, the indoor air or the external air introduced through the suction port 11 is cooled to have desired temperature and humidity by means of a heat exchanger employed in the air conditioner, and then the cooled air is exhausted through the exhaust ports 12, so as to maintain the indoor air at a more pleasant state.

Hereinafter, the construction and the operation of the conventional ceiling-embeded cassette type air conditioner will be described in detail, with reference to the, internal construction of the conventional ceiling-embeded cassette type air conditioner. FIGS. 2 and 3 are transverse and longitudinal sections of the conventional ceiling-embeded cassette type air conditioner.

Referring to FIGS. 2 and 3, in the ceiling-embeded cassette type air conditioner, the external air is introduced through the suction port 11, which is disposed at a lower portion of the air conditioner, and then the air passes through a bell mouth 16 having a specific shape for decreasing a reduction of pressure, thereby preventing the decrease of efficiency due to the reduction of pressure. Further, the air conditioner includes a driving motor 13 for generating a rotation force and a turbo fan 17 coupled to a rotation shaft of the driving motor 13, so that the indoor air is introduced into the air conditioner by the rotation of the turbo fan 17.

Moreover, the indoor air, which has passed through the suction port 11, the bell mouth 16 and the turbo fan 17 in order, absorbs or discharges heat at a heat exchanger 14, according to the operation state of the ceiling-embeded cassette type air conditioner.

Then, the indoor air, which has passed through the heat exchanger 14 to have desired temperature and humidity, is discharged through the exhaust ports 12 into an indoor space to be air-conditioned. In this case, the indoor air is guided to the exhaust ports 12 by a channel defined according to size and shape of a cabinet 15.

Hereinafter, the construction of the conventional turbo fan 17 as mentioned above will be described in detail, with reference to FIG. 4, which is a perspective view of the turbo fan.

Referring to FIG. 4, the conventional turbo fan includes blades 17*a* for providing a flowing force, which enables the fluid or the indoor air to be introduced into and exhausted from the air conditioner, a shroud 17*b* disposed above the blades 17*a* to prevent the exhausted fluid from being introduced back, and a hub 17*c* disposed under the blades 17*a* to fix the blades 17*a*.

In the meantime, the turbo fan 17 as described above is usually manufactured by an injection molding. In this case, it is preferred that the turbo fan 17 is integrally formed in the process of the injection molding. However, it is nearly impossible to integrally form the turbo fan 17 due to the structural limitation of the shape of the fan, especially due to the shape of the shroud.

Because of this problem in the above process of manufacturing the turbo fan 17, other manufacturing methods have been utilized in manufacturing the turbo fan 17. That is, in a first alternative method, all elements of the fan but the shroud 17*b* are integrally formed by the injection molding, and then the separately formed shroud 17*b* is assembled with the other elements. Otherwise, in a second alternative method, the hub 17*c* has a reduced outer diameter, so that the entire turbo fan 17 can be integrally formed.

However, in the first alternative method, because the shroud 17*b* and the other elements are separately manufactured and then assembled with each other, it is not economical in manufacturing time and expense due to such additional labors. Further, in the second alternative method; although it is easier to manufacture the turbo fan 17 due to the reduced outer diameter of the hub 17*c*, it is problematic that the entire quantity of air blown by the turbo fan 17 is reduced and the operational noise is increased due to the relatively complicated flow of the fluid.

SUMMARY OF THE INVENTION

Accordingly, the present invention has been made in an effort to solve the problems occurring in the related art, and it is an object of the present invention to provide a turbo fan of a ceiling-embeded cassette type air conditioner, having an improved construction, which not only enable the turbo fan to be manufactured by easier labor but also prevent a decrease of the quantity of blown-air and reduce a generation of noise.

In accordance with one aspect of the present invention, there is provided a turbo fan of a ceiling-embeded cassette type air conditioner, the turbo fan comprising: a shroud for guiding a fluid introduced into the turbo fan; a hub having an outer diameter smaller than an inner diameter of the shroud, so as to facilitate an integral injection molding of the turbo fan; and blades extending between the shroud and the hub and being perpendicular to the shroud and the hub, each of the blades having an inner diameter, which is inclined in such a manner that the inner diameter is decreased from the shroud to the hub, so that a quantity of sucked-air and a static pressure can be increased.

The present invention provides a superior turbo fan of a ceiling-embeded cassette type air conditioner, which not only can be integrally formed by injection molding but also can be manufactured at a reduced manufacturing cost. Further, the present invention can effectively overcome the undesired problem of the prior art due to the modification in dimensions of the turbo fan, thereby providing a turbo fan exhibiting a quantity of blown-air and a static pressure which are the same or increased in comparison with the prior art.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

The above and other objects, characteristics, and advantages of the present invention will become apparent from the following description with reference to the accompanying drawings.

Figure 1:
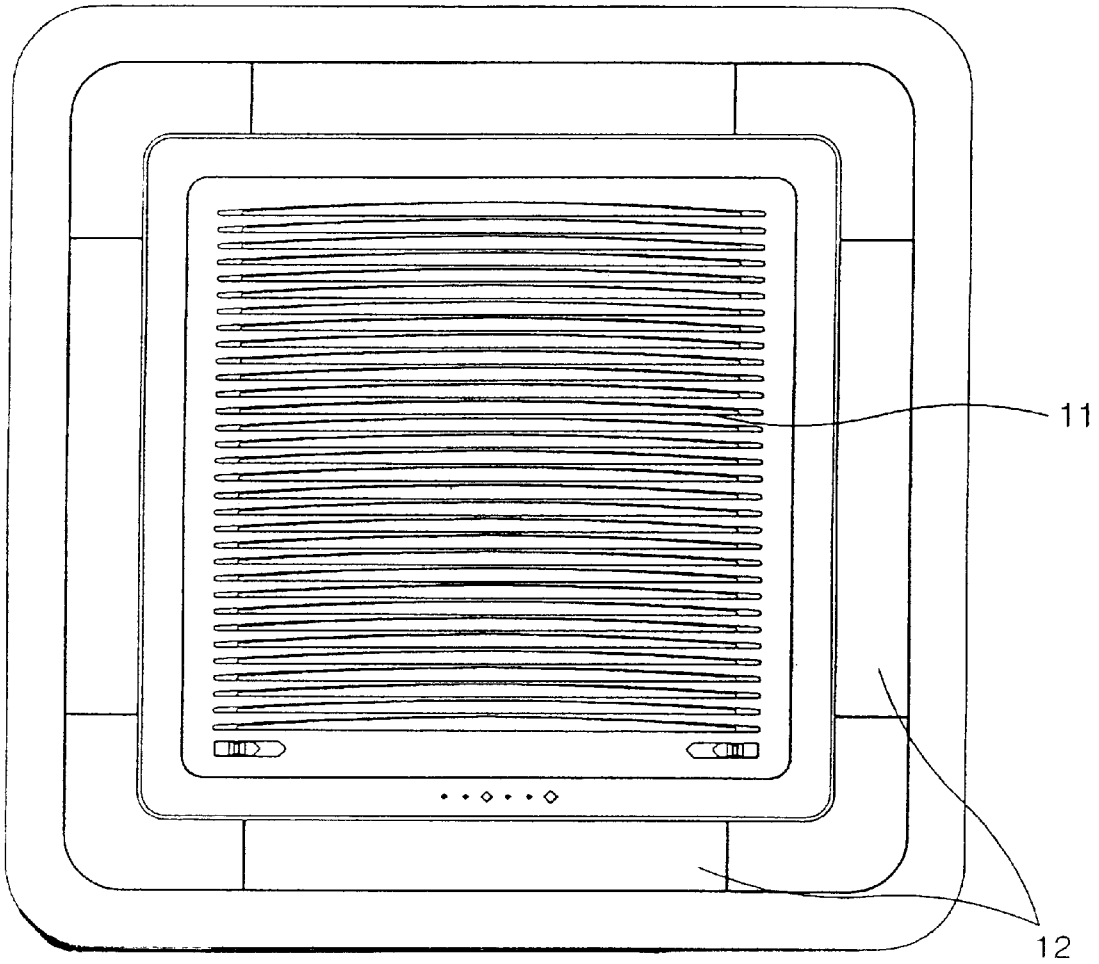
FIG. 1 BACKGROUND ART
FIG. 1 is a bottom view of a conventional ceiling-embeded cassette type air conditioner.
Figure 2:
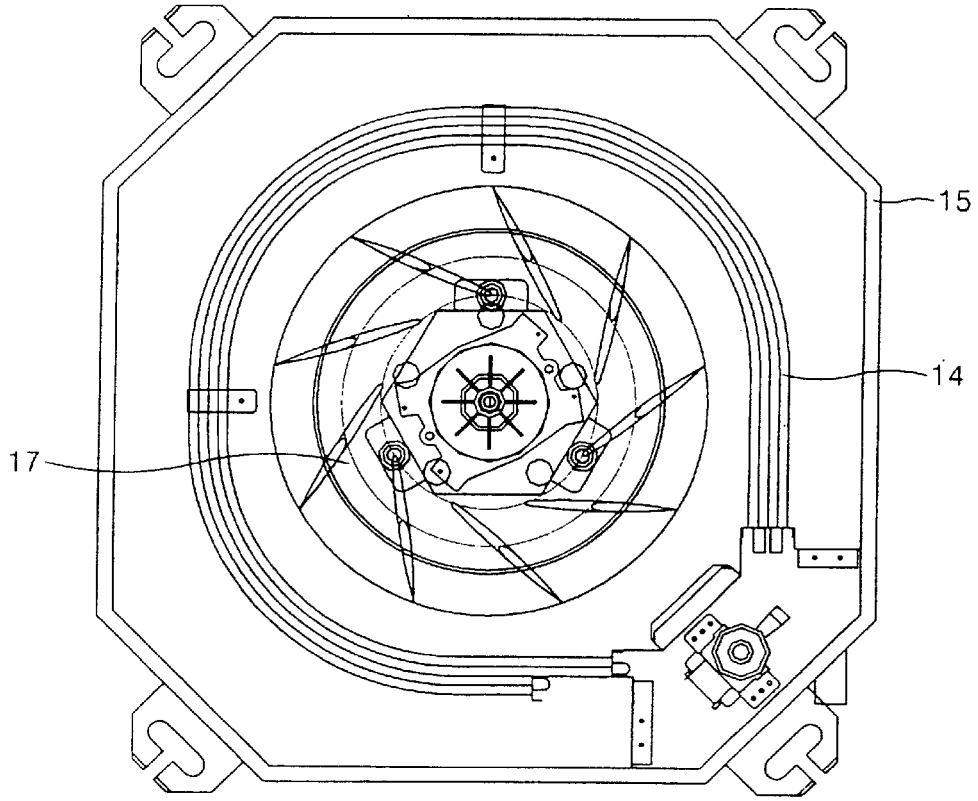
BACKGROUND ART FIG. 2
FIG. 2 is a transverse section of the conventional ceiling-embedded cassette type air conditioner.
Figure 3:
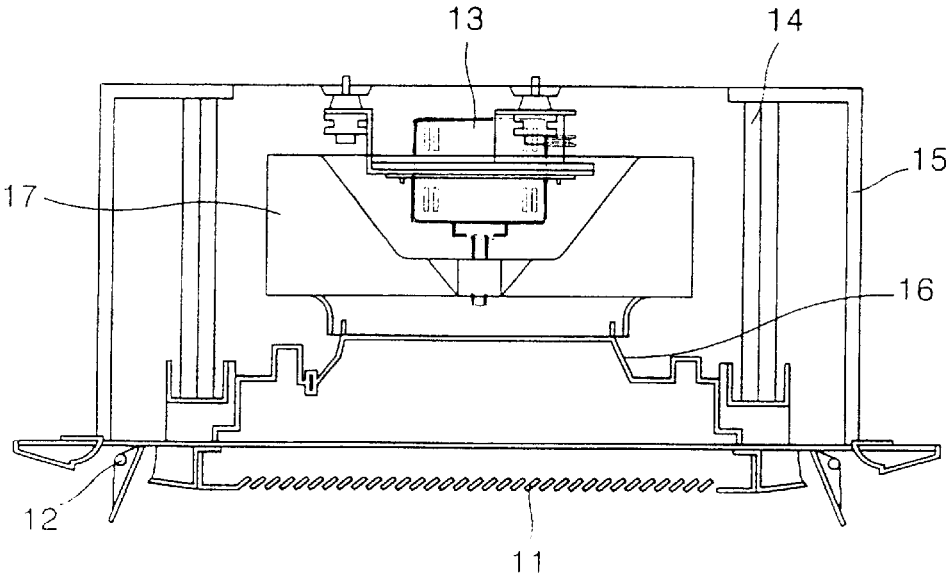
FIG. 3 BACKGROUND ART
FIG. 3 is a longitudinal section of the conventional ceiling-embeded cassette type air conditioner.
Figure 4:
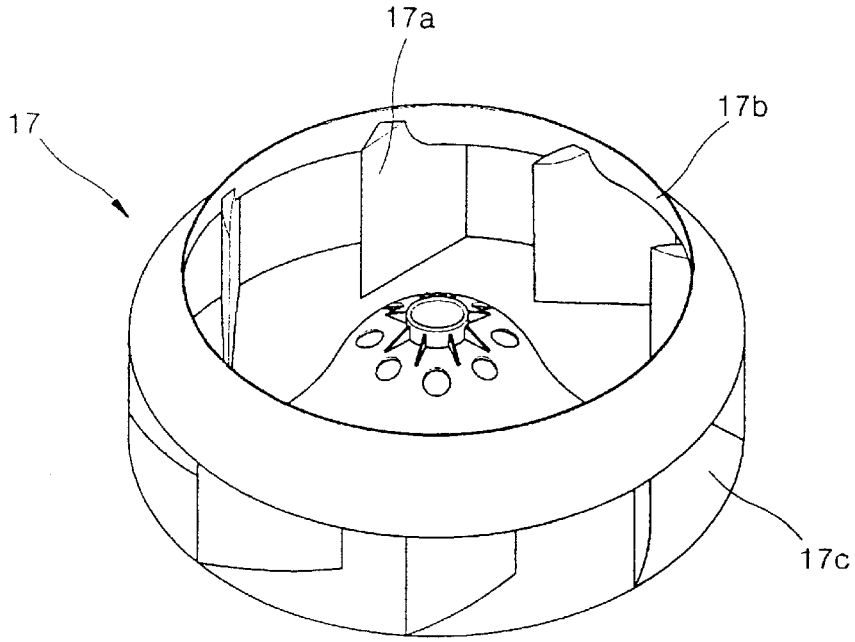
FIG. 4 BACKGROUND ART
FIG. 4 is a perspective view of a turbo fan employed in the conventional ceiling-embeded cassette type air conditioner.
Figure 5:
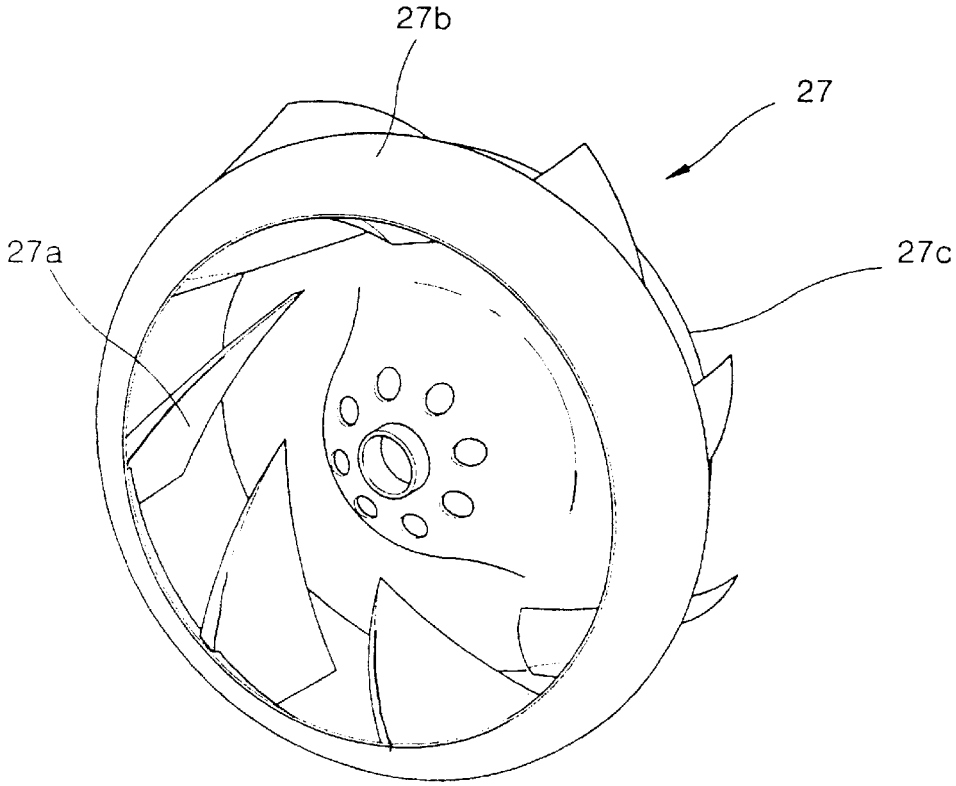
FIG. 5 is a perspective view of a turbo fan employed in a ceiling-embeded cassette type air conditioner according to the present invention.

Referring to FIG. 5, which is a perspective view of a turbo fan according to the present invention, a turbo fan of the present invention includes a hub 27*c* having a reduced outer diameter so as to prevent an integral injection molding of the turbo fan from being disturbed, blades 27*a* extending perpendicularly from the hub 27*c* so as to prevent deterioration of efficiency of a turbo fan 27 due to the hub 27*c* having a reduced outer diameter, and a shroud 27*b* disposed at ends of the blades 27*a* opposite to the hub 27*c* so as to exactly guide the introduced external fluid.

Especially, the blades 27*a* of the present invention have inflow edges that are inclined to form a curved recess having changing diameters, which are different between the shroud-side and the hub-side. In more detailed description, the inner diameter of the blades 27*a* at the hub-side is smaller than that at the shroud-side, so as to increase the quantity of the fluid introduced thereinto. Moreover, each of the blades 27*a* has an increased length at the hubside, so as to increase the static pressure and the quantity of blown-air.

Figure 6:
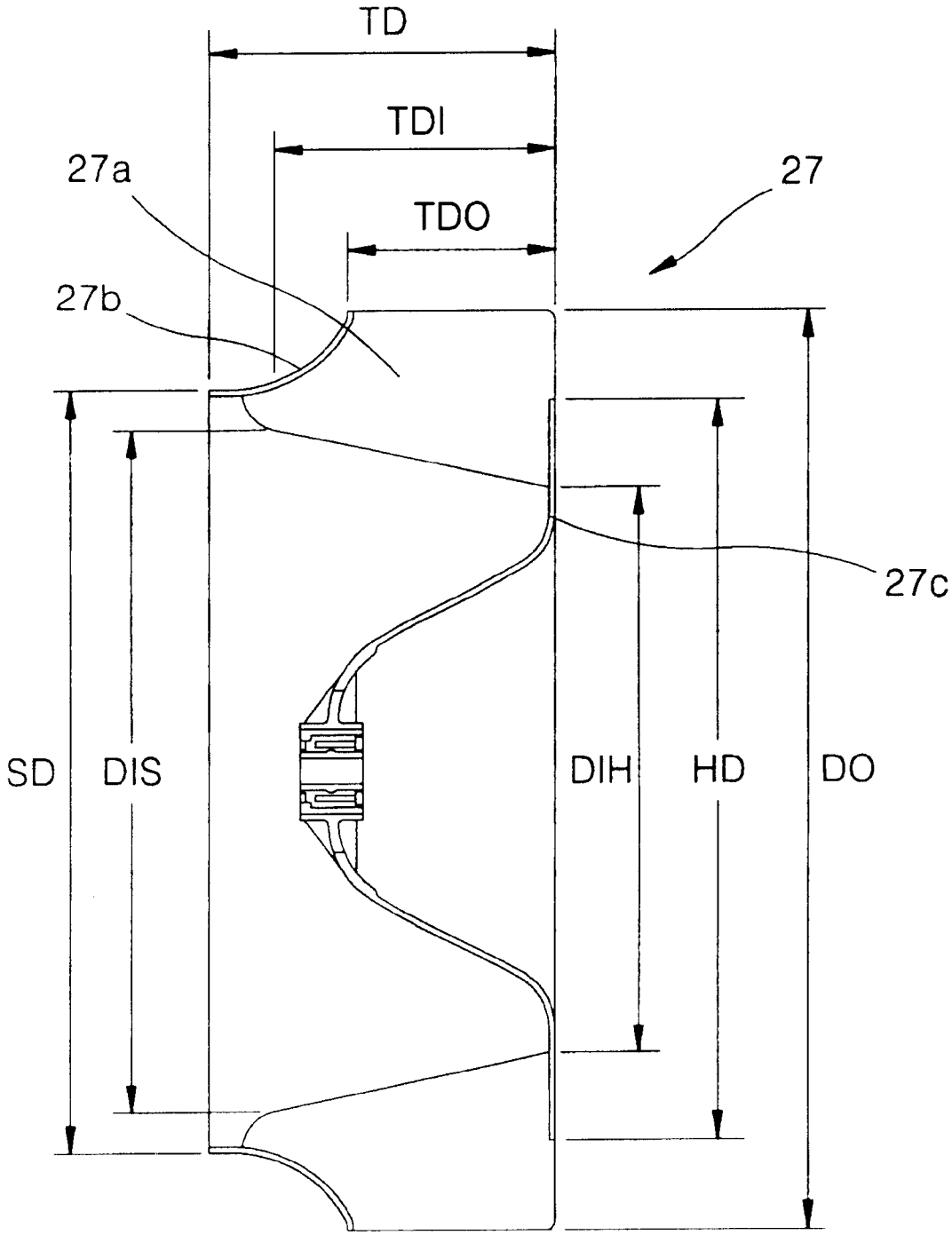
FIG. 6 is a longitudinal section of the turbo fan employed in a ceiling-embeded cassette type air conditioner according to the present invention.

In addition to the above improvement in a general shape of the fan, more detailed change in the shape of the ceiling type turbo fan including particular dimensions, which the present invention also provides, will be described hereinafter with reference to FIG. 6, which is a sectional view of a turbo fan according to the present invention. That is, it is preferred that an entire height TD of the turbo fan has a value in a range of 30 to 40% of an entire outer diameter DO of the turbo fan, an outflow port height TDO of the turbo fan has a value in a range of 55 to 65% of the entire height TD of the turbo fan, and an inflow port height TDI of the turbo fan has a value in a range of 80 to 90% of the entire height TD of the turbo fan. The inflow port height TDI is the distance from the outer portion of the hub 27*c* to a point on the inflow edge of each of the blades 27*a* at an intersection of a curved portion and a linear portion in the axial direction, as shown in FIG. 6.

Preferably, a shroud inner diameter SD has a value in a range of 75 to 85% of the entire outer diameter DO of the turbo fan.

Further, in an aspect of the shape of the blades 27*a*, a hub side diameter DIH of the recesses of the blades 27*a* has a value in a range of 55 to 65% of the entire outer diameter DO of the turbo fan, and a shroud-side diameter DIS of the recesses of the blades 27*a* has a value in a range of 70 to 80% of the entire outer diameter DO of the turbo fan. Furthermore, only when a hub outer diameter HD is smaller than the shroud inner diameter SD and larger than the hub-side recess diameter DIH, the turbo fan does not show any difference or degradation in the efficiency of the fan and the manufacture of the fan by molding.

Meanwhile, the shroud-side recess diameter DIS of the blades 27*a* is larger than the hub-side recess diameter DIH, so that the blades are not even but inclined between the inflow-side and the outflow-side. This inclined construction eliminates the problem of the prior art in integrally forming a turbo fan 27 by injection molding. The shroud-side recess diameter DIS is the distance from a point on the inflow edge of a blade 27*a* at an intersection of a curved portion and a linear portion of the blade to a point on a blade 27*a* directly opposite at an intersection of a curved portion and a linear portion of the opposite blade.

Figure 7:
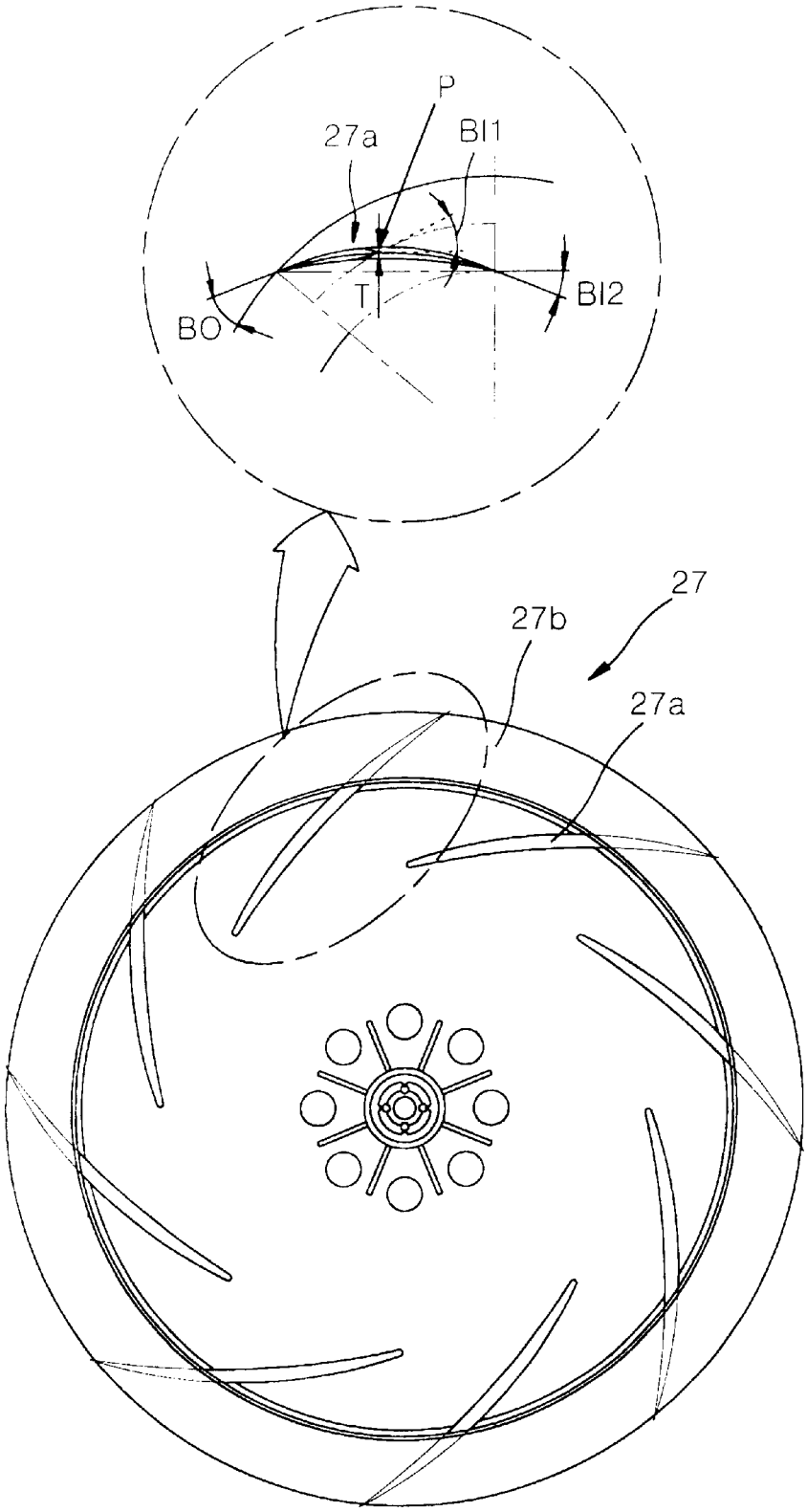
FIG. 7 is a plan view of the turbo fan together with an enlarged sectional view of a blade employed in the turbo fan according to the present invention.

FIG. 7 is a plan view of the turbo fan together with an enlarged sectional view of a blade employed in the turbo fan according to the present invention.

Referring to FIG. 7, in the blade of the present invention, it is preferred that an inflow angle BI1 of the blade at the shroud-side has a value between 25° C. and 40°, an inflow angle BI2 of the blade at the hub-side has a value between 15° and 30°, and an outflow angle BO of the blade has a value between 35° and 45°. As shown in FIG. 7, the inflow angle BI1 of the blade at the shroud-side is the angle between the circular rim of the shroud 27*b* and the blade 27*a* at the point where the blade 27*a* is attached to the rim of the shroud 27*b*. The inflow angle BI2 of the blade at the hub-side is the angle between the circular rim of the shroud 27*b* and the blade 27*a* at the point where the blade 27*a* is attached to the hub 27*c*. Finally, the outflow angle BO of the blade is the angle between the circular periphery of the shroud 27*b* and the blade 27*a* at the point where the blade 27*a* is attached to the periphery of the shroud 27*b*.

Further, the number of the blades in total has a value between 7 and 10. The maximum camber T at the hub-side has a value between 4 to 7% of the entire length of the hub-side blade chord, and the maximum camber at the shroud-side has a value between 6 to 9% of the entire length of the shroud-side blade chord. Also, the maximum camber of the blade is located at a position between 0.3 and 0.5 from the leading edge when the entire length of the blade chord is put as 1.

The above described construction as shown in FIGS. 6 and 7 according to the present invention has been proposed with a view to overcoming a difficulty in manufacturing a turbo fan 27 together with preventing the decrease of the efficiency of a turbo fan 27 due to the reduction of the outer diameter of the hub (see the hub 27*c* FIG. 5). Hereinafter, the above constructional modification and the function thereof will be described in detail.

The problem of the prior art in integrally forming the hub and the shroud in the process of the injection molding is efficiently overcome by the properly reduced hub outer diameter HD of the hub according to the present invention.

Moreover, in the present invention, the hub-side recess diameter DIH is smaller than the entire outer diameter DO of the turbo fan, so that the blade chord is lengthened to thereby increase the static pressure. In addition, the shroud-side recess diameter DIS is larger than the hub-side recess diameter DIH, so that an inflow area defined by the blades, a fluid-introducing area of the blades, is relatively increased. Consequently, not only the quantity of the introduced fluid can be relatively increased but the static pressure can also be relatively increased, so that a reduction in the quantity of blown-air due to the reduction of the hub outer diameter HD can be compensated for. Therefore, the present invention provides a turbo fan having the same or the better efficiency in comparison with the prior art.

In the meantime, the outflow-side of the blades is formed to have the same size with the entire outer diameter DO of the turbo fan, thereby efficiently preventing a possible reduction of the static pressure and the quantity of blown-air, which may happen due to the elimination of the hub 27*c*.

Especially, the detailed dimensions of the ceiling-embeded cassette type air conditioner as described above have been obtained through many experiments under various conditions.

As described above, the present invention provides a superior turbo fan of a ceiling-embeded cassette type air conditioner, which not only can be integrally formed by injection molding but also can be manufactured at a reduced manufacturing cost. Further, the present invention can effectively overcome the undesired problem of the prior art due to the modification in dimensions of the turbo fan, thereby providing a turbo fan exhibiting a quantity of blown-air and a static pressure which are the same or increased in comparison with the prior art.

While there have been illustrated and described what are considered to be preferred specific embodiments of the present invention, it will be understood by those skilled in the art that the present invention is not limited to the specific embodiments thereof, and various changes and modifications and equivalents may be substituted for elements thereof without departing from the true scope of the present invention.

What is claimed is:

1. A turbo fan of a ceiling-embedded cassette air conditioner, the turbo fan comprising:

a shroud for guiding a fluid introduced into the turbo fan;

a hub having an outer diameter smaller than an inner diameter of the shroud, so as to facilitate an integral injection molding of the turbo fan; and blades extending between the shroud and the hub and being perpendicular to the shroud and the hub, each of the blades having inflow edges to form a curved recess, the inflow edges being inclined in such a manner that the diameter of the recess is decreased from the shroud to the hub, so that a quantity of sucked-air and a static pressure can be increased, wherein a maximum camber (T) of each of the blades at the hub-side has a value between 4 to 7% of an entire length of a hub-side blade chord, and the maximum camber at the shroud-side has a value between 6 to 9% of an entire length of the shroud-side blade chord.

2. The turbo fan of a ceiling-embedded cassette air conditioner as claimed in claim 1, wherein the outer diameter of the hub is larger than a hub-side recess diameter of the blades, so as to enable the hub, the blades, and the shroud to be integrally formed.

3. The turbo fan of a ceiling-embedded cassette air conditioner as claimed in claim 1, wherein an entire height (TD) of the turbo fan has a value in a range of 30 to 40% of an entire outer diameter (DO) of the turbo fan.

4. The turbo fan of a ceiling-embedded cassette air conditioner as claimed in claim 1, wherein an outflow port height (TDO) of the turbo fan has a value in a range of 55 to 65% of an entire height (TD) of the turbo fan.

5. The turbo fan of a ceiling-embedded cassette air conditioner as claimed in claim 1, wherein an inflow port height (TDI) of the turbo fan has a value in a range of 80 to 90% of an entire height (TD) of the turbo fan.

6. The turbo fan of a ceiling-embedded cassette air conditioner as claimed in claim 1, wherein an inner diameter (SD) of the shroud has a value in a range of 75 to 85% of an entire outer diameter (DO) of the turbo fan.

7. The turbo fan of a ceiling-embedded cassette air conditioner as claimed in claim 1, wherein a hub-side recess diameter (DIH) of the blades has a value in a range of 55 to 65% of an entire outer diameter (DO) of the turbo fan.

8. The turbo fan of a ceiling-embedded cassette air conditioner as claimed in claim 1, wherein a shroud-side recess diameter (DIS) of the blades has a value in a range of 70 to 80% of an entire outer diameter (DO) of the turbo fan.

9. The turbo fan of a ceiling-embedded cassette air conditioner as claimed in claim 1; wherein an inflow angle (BI1) of each of the blades at the shroud-side has a value between 25° and 40°, and an inflow angle (BI2) of each of the blades at the hub-side has a value between 15° and 30°.

10. The turbo fan of a ceiling-embedded cassette air conditioner as claimed in claim 1, wherein an outflow angle (BO) of each of the blades has a value between 35° and 45°.

11. A turbo fan of a ceiling-embedded cassette air conditioner, the turbo fan comprising:

a shroud for guiding a fluid introduced into the turbo fan;

a hub having an outer diameter smaller than an inner diameter of the shroud, so as to facilitate an integral injection molding of the turbo fan; and blades extending between the shroud and the hub and being perpendicular to the shroud and the hub, each of the blades having inflow edges to form a curved recess, the inflow edges being inclined in such a manner that the diameter of the recess is decreased from the shroud to the hub, so that a quantity of sucked-air and a static pressure can be increased, wherein a maximum camber of each of the blades is located at a position between 0.3 and 0.5 from an inflow edge when an entire length of a blade chord is put as 1.

12. The turbo fan of a ceiling-embedded cassette air conditioner as claimed in claim 11, wherein the outer diameter of the hub is larger than a hub-side recess diameter of the blades, so as to enable the hub, the blades, and the shroud to be integrally formed.

13. The turbo fan of a ceiling-embedded cassette air conditioner as claimed in claim 11, wherein an entire height (TD) of the turbo fan has a value in a range of 30 to 40% of an entire outer diameter (DO) of the turbo fan.

14. The turbo fan of a ceiling-embedded cassette air conditioner as claimed in claim 11, wherein an outflow port height (TDO) of the turbo fan has a value in a range of 55 to 65% of an entire height (TD) of the turbo fan.

15. The turbo fan of a ceiling-embedded cassette air conditioner as claimed in claim 11, wherein an inflow port height (TDI) of the turbo fan has a value in a range of 80 to 90% of an entire height (TD) of the turbo fan.

16. The turbo fan of a ceiling-embedded cassette type air conditioner as claimed in claim 11, wherein an inner diameter (SD) of the shroud has a value in a range of 75 to 85% of an entire outer diameter (DO) of the turbo fan.

17. The turbo fan of a ceiling-embedded cassette air conditioner as claimed in claim 11, wherein a hub-side recess diameter (DIH) of the blades has a value in a range of 55 to 65% of an entire outer diameter (DO) of the turbo fan.

18. The turbo fan of a ceiling-embedded cassette air conditioner as claimed in claim 11, wherein a shroud-side recess diameter (DIS) of the blades has a value in a range of 70 to 80% of an entire outer diameter (DO) of the turbo fan.

19. The turbo fan of a ceiling-embedded cassette air conditioner as claimed in claim 11, wherein an inflow angle (BI1) of each of the blades at the shroud-side has a value between 25° and 40°, and an inflow angle (BI2) of each of the blades at the hub-side has a value between 15° and 30°.

20. The turbo fan of a ceiling-embedded cassette air conditioner as claimed in claim 11, wherein an outflow angle (BO) of each of the blades has a value between 35° and 45°.

* * * * *